US005537689A

United States Patent [19]

Dancyger

[11] Patent Number: 5,537,689

[45] Date of Patent: Jul. 23, 1996

[54] PROTECTIVE KNEEPAD HAVING A SINGLE PIECE CUPPING MEANS AND STITCH RECEIVING GROOVE

[76] Inventor: Michael Dancyger, 811 W. 58th St., Los Angeles, Calif. 90037

[21] Appl. No.: 377,953

[22] Filed: Jan. 25, 1995

[51] Int. Cl.[6] ..... A41D 13/06

[52] U.S. Cl. ..... 2/24

[58] Field of Search ..... 2/22, 23, 24, 62, 2/911, 16, 20, 267

[56] References Cited

U.S. PATENT DOCUMENTS

| | | | |
|---|---|---|---|
| 1,525,298 | 2/1925 | Hartman | 2/24 |
| 5,077,837 | 1/1992 | Meistrell | 2/24 X |
| 5,168,576 | 12/1992 | Krent et al. | 2/267 X |
| 5,222,256 | 6/1993 | Wang | 2/24 |

*Primary Examiner*—C. D. Crowder
*Assistant Examiner*—Shirra L. Jenkins
*Attorney, Agent, or Firm*—Andra Vaccaro

[57] ABSTRACT

A knee pad having main body comprised of a piece of foam or the like covered with a protective coating such as fabric. The foam has a top and a bottom and a front end and a back end. The foam is enclosed in a cover having a front side and a bad side. A substantially egg-shaped cup is placed on the front side of the cover. The cup is shaped so that it conforms to the knee and, in the preferred embodiment, is ergonometrically designed so as to provide easy swivelling around the knee without slippage. The cup is stitched to the pad through both sides of the cover and through the foam around the outer edge at the top and bottom thereof. The stitching on the cup in placed in a groove near the outer edge of the cup. Affixed to each side of the cover there are two strapping means comprised of elastic or the like for attaching the kneepad to the knee of the user.

5 Claims, 4 Drawing Sheets

FIG. 1
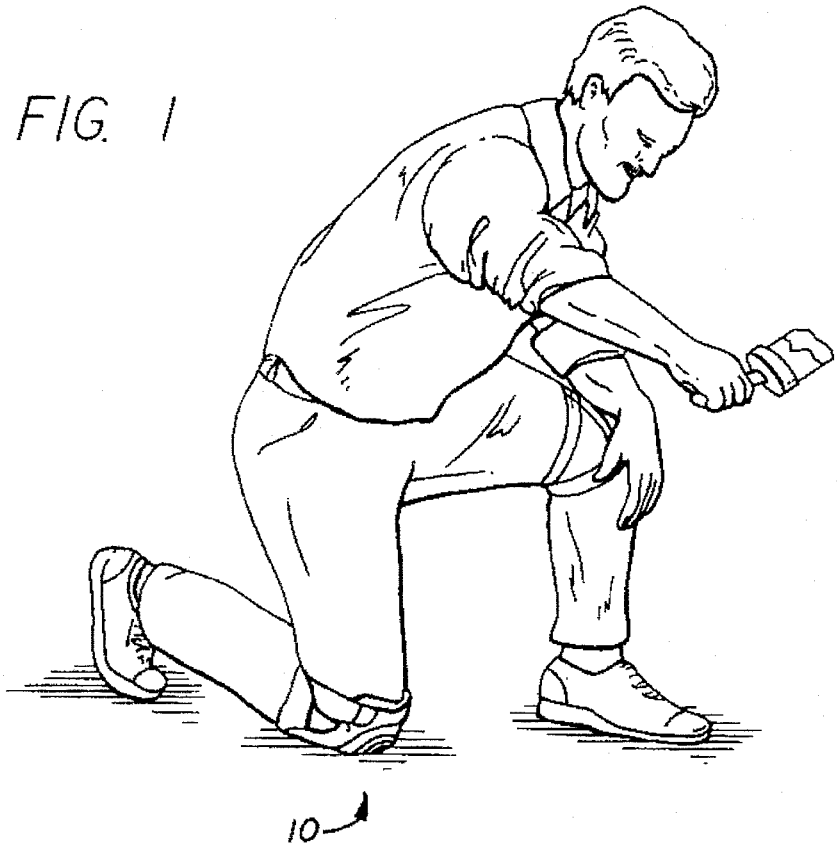
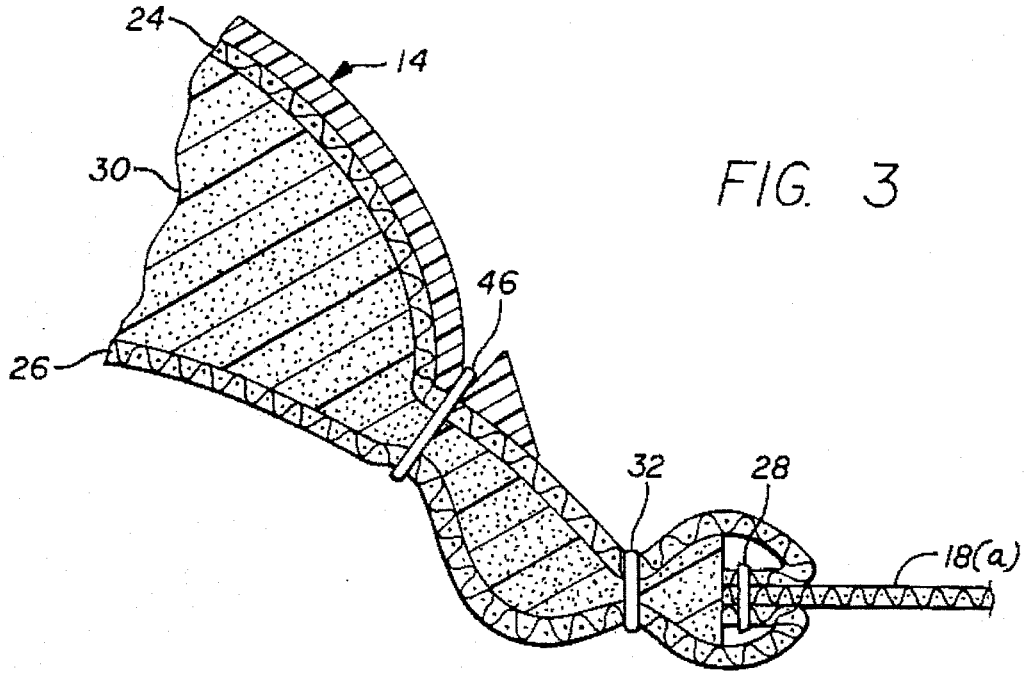
FIG. 3

PROTECTIVE KNEEPAD HAVING A SINGLE PIECE CUPPING MEANS AND STITCH RECEIVING GROOVE

BACKGROUND OF THE INVENTION

FIELD OF THE INVENTION

The invention relates to the field of kneepads that are used to protect the knees when kneeling on a surface.

SUMMARY OF INVENTION

The present invention relates to kneepads for use by construction workers and other laborers, such as painters, gardeners and others who wish to kneel without hurting either their knees or damage their clothing in the knee area.

The present invention is an improvement over the prior art insofar as the pattern on the kneepad is ergonometrically designed for easy movability, yet still prevents skidding. In addition, in the prior art, the cup on the surface of the pad is attached to pad either by surface stitching so that the thread is on the surface of the cup or through rivets, which are hard on the knees. When prior art pads on which the cup is attached by stitching are used, the stitching thread constantly gets rubbed against the kneeling surface and eventually wears through.

In the present invention, the stitching is recessed in a grove near the outer edge of the cup so that it does not get rubbed against the kneeling surface when the pad is used and thus, the kneepad has greater longevity.

The present invention comprises a main body comprised of a piece of foam or the like covered with a protective coating such as fabric. The foam has a top and a bottom and a front end and a back end. The foam is enclosed in a cover having a front side and a bad side. The front side is comprised of material such as heavy duty cordura. The back side is comprised of thick nylon padding or the like.

A substantially egg-shaped cup is placed on the front side of the cover. The cup is shaped so that it conforms to the knee. In the preferred embodiment, the cup is stitched to the pad through both sides of the cover and through the foam. The stitching on the cup in placed in a groove near the outer edge of the cup. Affixed to each side of the cover there are two strapping means comprised of elastic or the like for attaching the kneepad to the knee of the user.

In the preferred embodiment, the cup is ergonometrically designed so as to provide easy swivelling around the knee without slippage. Specifically the upper portion of the cup comprises concentric oval shaped rings, with the smallest ring at the tip of the knee joint. The lower portion of the cup comprises a plurality of closely spaced concentric arcs of decreasing size, with the largest arc closest to the knee and the smallest arc proximate the bottom of the cup.

In the preferred embodiment, the strapping means comprises four straps, each strap having one end affixed to the side seam of the cover and the other end having either hook or loop material thereon for connecting with the strap on the opposite side, such that the strap may be fastened tightly around the knee by placing the hook material on the loop material. However, other suitable fastening means may be used.

BRIEF DESCRIPTION OF THE DRAWINGS

FIG. 1 is a perspective view of the kneepad being utilized on a person;

FIG. 3 is an enlarged fragmentary cross section taken along line 3—3 of FIG. 2;

DESCRIPTION OF PREFERRED EMBODIMENTS

Figure 2:
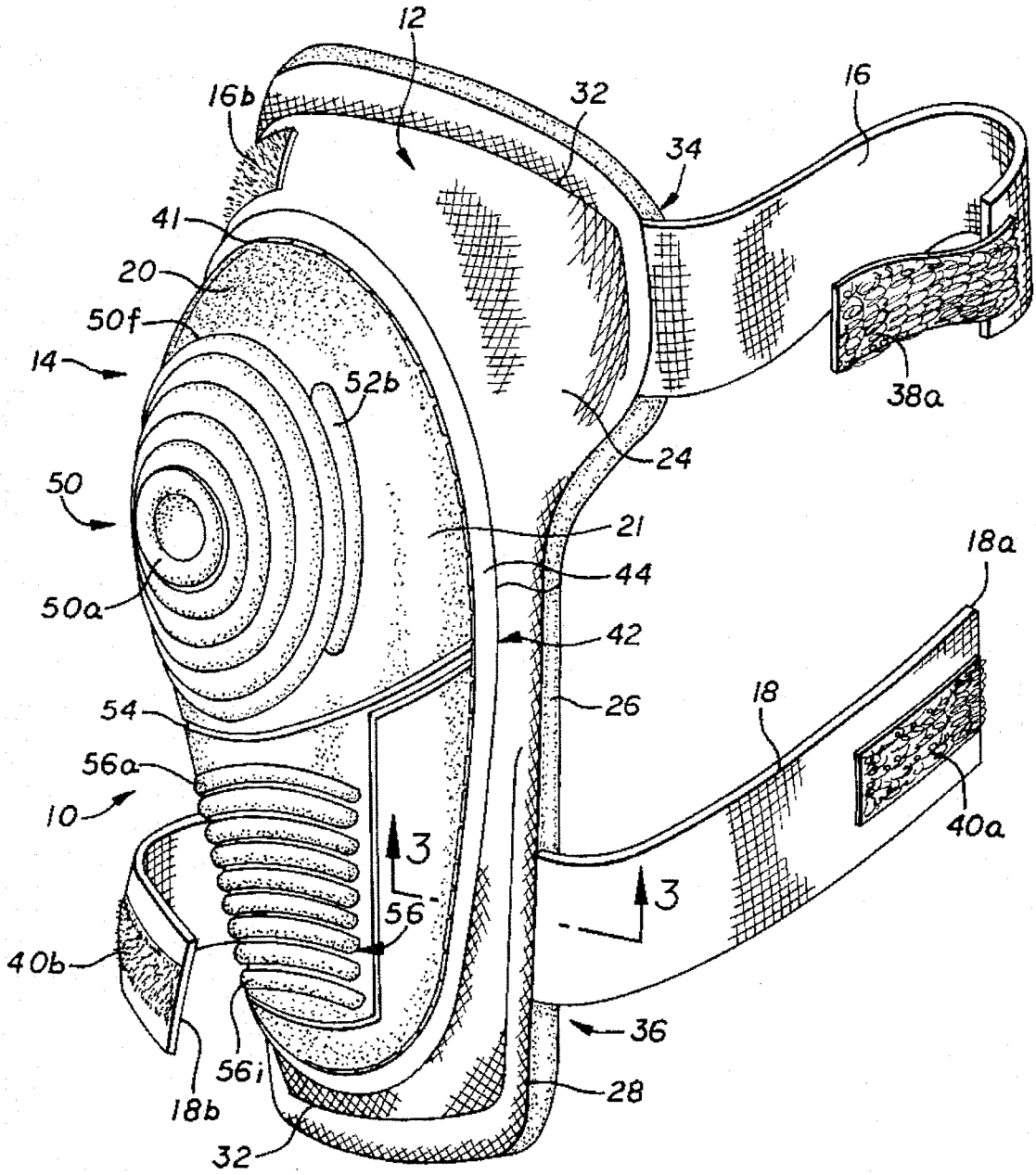
FIG. 2 is a front right perspective view of the kneepad.
Figure 4:
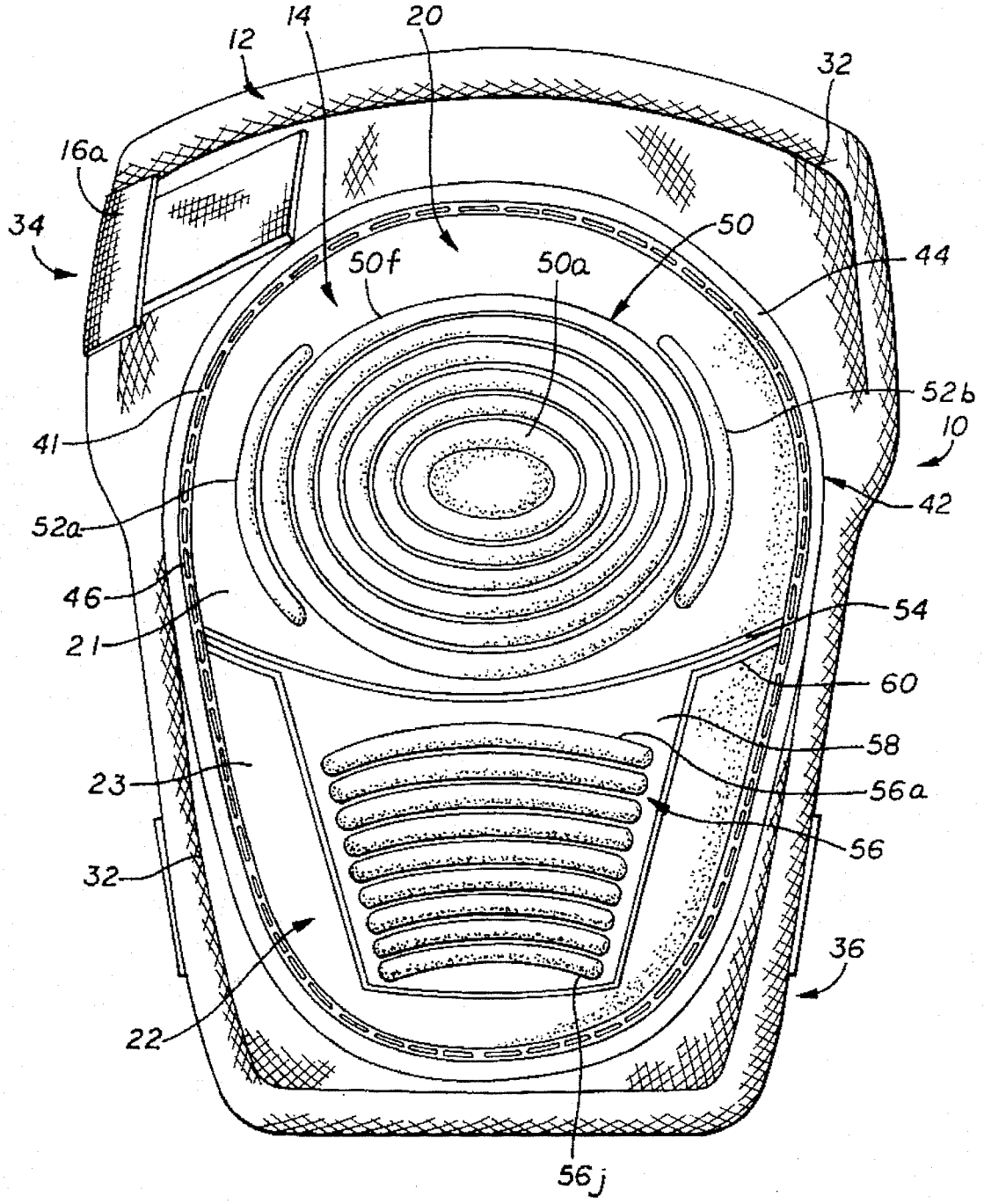
FIG. 4 is a front elevational view of the kneepad.
Figure 5:
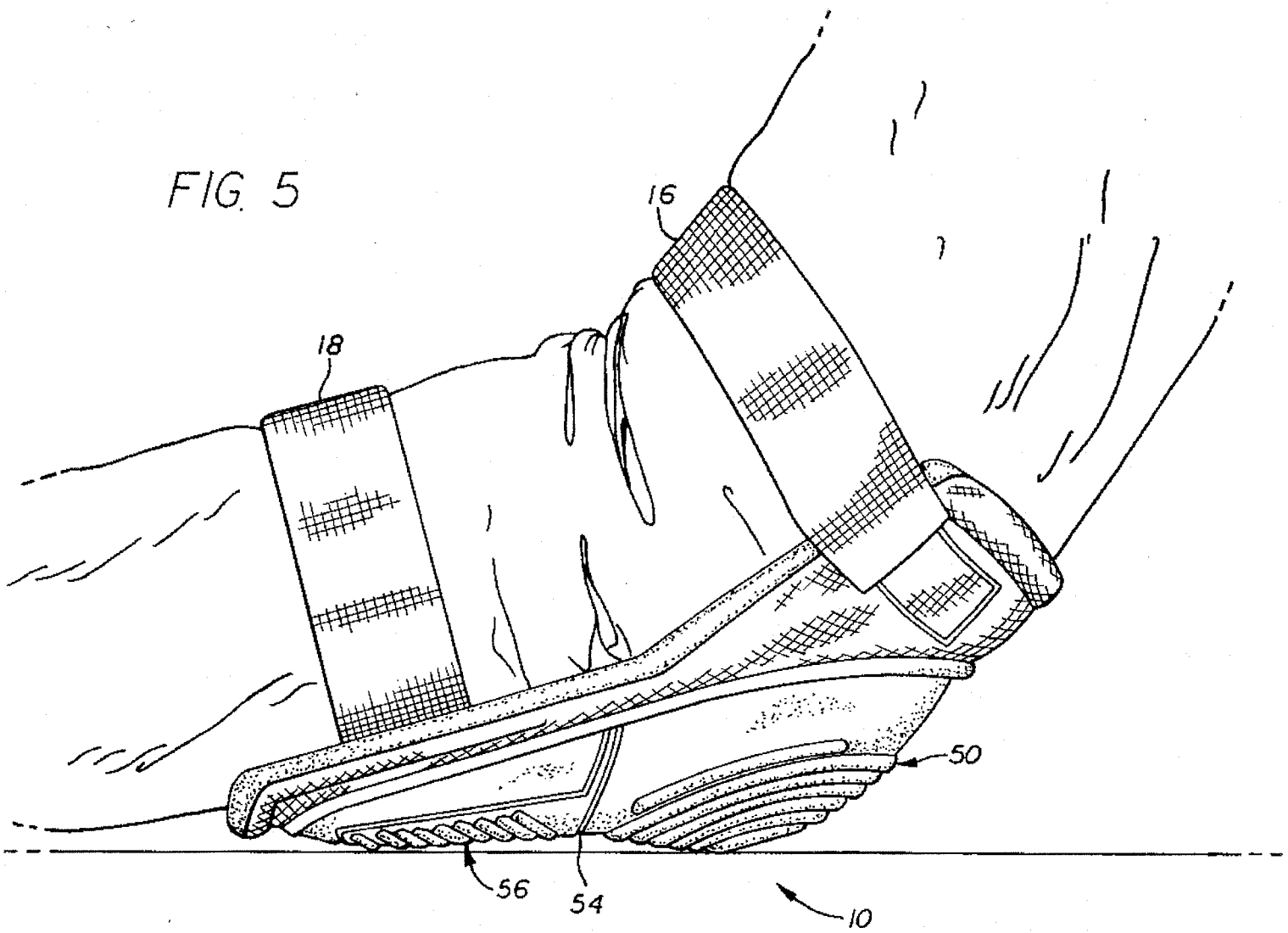
FIG. 5 is a left side elevational view of the kneepad in use.

Referring to the drawings, and more specifically to FIG. 2, there is shown in FIGS. 1 through 5, a kneepad 10. Kneepad 10 comprises a main body 12, a cup 14 and strapping means 16 and 18. Referring to FIG. 3, the kneepad comprises a first layer of substantially rigid material such as cup 14, a second layer of heavy duty fabric material 24, a third layer of cushioning material 30 and a fourth layer of heavy duty fabric material 26. Referring to FIGS. 2 and 4, cup 14 is comprised of a substantially hard piece of material such as plastic or rubber. Cup 14 is shaped so that it will conform to the knee when the user is kneeling. In the preferred embodiment, the cup 14 has an upper portion 20 having an outer surface 21 and a lower portion 22 having an outer surface 23. The upper portion 20 of the cup 14 is substantially concave so that it will fit around the knee when it is bent is a kneeling position, as is shown in FIGS. 1 and 5. The lower portion 22 is slightly concave so as to fix around the lower portion of the knee and upper leg or shin area proximate the lower portion of the knee, also as shown in FIGS. 1 and 5.

The main body 12 of the kneepad 10 has a top surface 24 and a back surface 26, which are affixed together by stitching 28. Between the top surface 24 and back surface 26 is a hard but semi-flexible piece of material 30 such as foam. The foam 30 is held in place inside the top and bottom surfaces 24 and 26 of the main body 12 by stitching 32.

Cup 14 have a groove 41 around the outer edge 42 thereof so that a lip 44 is formed. The cup 14 is affixed to the main body by placing stitches 46 sewn in the groove area 41 through the top surface, semi-flexible material 30 and the back surface 26. By stitching the cup 20 in the groove 41, the stitches 46 are recessed and protected so that when the kneepad 10 is in use, the stitches 46 will not rub against the kneeling surface.

Strapping means 16 and 18 for strapping the kneepad around the body of the user are affixed to each side of the main body 12 proximate the upper front portion 34 and lower front portion 36 thereof. Strapping means 16 and 18 are comprised of a material such as elastic.

In the preferred embodiment, the strapping means 18 comprise two straps, having two ends 18*a* and 18*b* respectively, each end on each strap having fastening means thereon 4O*a* and 40*b*, respectively, that may be fixedly engaged with each other. In the preferred embodiment, fastening means 4O*a* is hook material on the outsides thereof and fastening means 4O*b* has loop material on the inside thereof, such that the straps may be fastened around the leg proximate the bottom of the knee by placing the hook material on the loop material. In the preferred embodiment, the strapping means 16 comprise one strap 16*a*, having an end 38*a* having fastening means thereon and a second strap 16*b* affixed to the upper portion 32 of the main body 12 having fastening means 4O*b* thereon, such that 4O*a* and 4O*b* may be fixedly engaged with each other. In the preferred embodiment, fastening means 40*a* is a hook material on the outside thereof and fastening means 40*b* has loop material on the inside thereof, such that the straps may be fastened around the leg proximate the bottom of the knee by placing the hook material on the loop material, as shown in FIG. 5. However, any other suitable fastening means may be used that will hold the kneepad around the knee comfortably and which will prevent the kneepad from slipping. Strapping means 16 and 18 are sized so as to accommodate knees of varying sizes and weights.

In the preferred embodiment, the cup 14 is ergonometrically designed for easy movability and swivelling around the knee, yet still prevents skidding and slipping. Specifically the upper portion 21 of the cup 14 comprises concentric oval shaped beaded rings 50 of graduated size which are closely, but equally, spaced apart, with the smallest beaded ring 50*a* at the tip of the knee joint. The largest concentric oval ring 5O*f* is surrounded on each sided by beaded arcs 52*a* and 52*b* which are of equal size and spaced apart from the largest ring 50*f* by the same distance as all of the rings from each other.

The lower portion 23 of the cup 14 is separated from the upper portion 21 by a slight groove 54. The lower portion 23 comprises a plurality of closely equally spaced concentric beaded arcs 56 of decreasing size, with the largest beaded arc 56*a* closest to the knee and the smallest arc 56*i* proximate the bottom of the cup. The arcs 56 are located within an area 58 in the lower portion 23 which is set off by a slightly recessed groove 60, which surrounds the arcs.

The erogonometric designs 50 and 56 on the cup 14 prevents the user from slipping while the centermost concentric oval ring 50*a* becomes a pivot point.

In manufacturing the item, the front 24 and back 26 of the main body 10 are stitched together to form a cover. The foam 30 is then placed inside the cover and stitched into place with stitching 32. The cup 14 is then placed on the front 24 of the cover and the cover is stitched in the grooved area 41 through the front 24, back 26 and foam 30 so as to hold the foam 30 and cover in place.

While particular embodiments of the invention have been shown and illustrated herein, it will be understood that many changes, substitutions and modifications may be made by those persons skilled in the art. It will be appreciated from the above description of presently preferred embodiments that other configurations are possible and within the scope of the present invention. Thus, the present invention is not intended to be limited to the particular embodiments specifically discussed hereinabove.

What is claimed is:

1. A kneepad which is worn on the knee of a user, comprising:

a cover having a top and a bottom surface that are affixed together, padding means located and affixed within said cover, stitching means, a substantially egg-shaped cupping means for protecting and surrounding the knee and shin area proximate the knee, said cupping means having groove proximate the entire perimeter thereof, said cupping means being attached to said cover and said padding means by said stitching means which are placed wholly within said groove, wherein said egg-shaped cupping means is wider and substantially concave proximate the wearer's knee and tapers in depth and width from the knee to the shin, whereby when the kneepad is worn by the user such that the area proximate said groove is placed in contact with a surface, the stitching means is protected from abrasion during use by being placed wholly within and not extending above said recessed groove, and strapping means attached to said cover for attaching the kneepad to the knee area of the user.

2. The kneepad of claim 1 whereby said cupping means comprises ergonometric upper and lower means for easy moving and swivelling around the knee of the user and for preventing skidding and slipping.

3. A kneepad which is worn on the knee of a user, comprising:

a cover having a top and a bottom surface that are affixed together, padding means located and affixed within said cover, stitching means, a substantially egg-shaped concave cupping means for protecting and surrounding the knee, said cupping means comprising upper portion having graduated concentric oval shaped beaded rings equally spaced apart, with the smallest beaded ring being located on the cupping means so that it is at the tip of the knee of the user, and a lower portion comprises a plurality of closely equally spaced concentric beaded arcs of decreasing size, with the largest beaded arc closest to the knee and the smallest arc proximate the bottom of the cup whereby the cup prevents the user from slipping while the centermost concentric oval ring becomes a pivot point of said cupping means further comprising a groove proximate the perimeter thereof, said cupping means being attached to said cover by said stitching means which are placed wholly within said groove, whereby when the kneepad is worn by the user, the stitching means is protected from abrasion during use by being placed wholly within said groove, and strapping means attached to said cover for attaching the kneepad to the knee area of the user.

4. A kneepad which is worn on the knee of a user, comprising:

a cover having a top and a bottom surface that are affixed together, padding means located and affixed within said cover, stitching means, a cupping means for protecting and surrounding the knee, said cupping means having a groove proximate the outer edge thereof, said cupping means comprising:

an upper portion having graduated concentric oval shaped beaded rings equally spaced apart, with the smallest beaded ring being located on the cupping means so that it is at the tip of the knee of the user, and a lower portion comprises a plurality of closely equally spaced concentric beaded arcs of decreasing size, with the largest beaded arc closest to the knee and the smallest arc proximate the bottom of the cup, said cupping means being attached to the top portion of the cover by said stitching means which are placed within the groove, and strapping means attached to said cover for attaching the kneepad to the knee area of the user, whereby the cupping means prevents the user from slipping while the centermost concentric oval ring becomes a pivot point.

5. A kneepad which is worn on the knee of a user, comprising:

a cover having a top and a bottom surface that are affixed together, padding means located and affixed within said cover, stitching means, a substantially egg-shaped concave cupping means for protecting and surrounding the knee having a groove thereon, said cupping means comprising:

an upper portion having graduated concentric oval shaped beaded rings equally spaced apart, with the smallest beaded ring being located on the cupping means so that it is at the tip of the knee of the user, a lower portion comprised of a plurality of closely equally spaced concentric beaded arcs of decreasing size, with the largest beaded arc closest to the knee and the smallest arc proximate the bottom of the cupping means, said cupping means being attached to the top surface of said cover by said stitching means which are placed wholly within the groove, strapping means attached to said cover for attaching the kneepad to the knee area of the user, whereby the cupping means prevents the user from slipping while the centermost concentric oval ring becomes a pivot point.

* * * * *